US007051625B1

(12) United States Patent
Lee

(10) Patent No.: US 7,051,625 B1
(45) **Date of Patent: *May 30, 2006**

(54) DETENT STRUCTURE OF A TORQUE WRENCH FOR ADJUSTING OPERATION ANGLE THEREOF

(76) Inventor: Chang Chuan Lee, P.O. Box 2103, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/033,819

(22) Filed: Jan. 13, 2005

(51) Int. Cl.
*B25B 23/16* (2006.01)

(52) U.S. Cl. ..... 81/177.8; 81/177.7

(58) Field of Classification Search ..... 81/177.8, 81/177.9, 177.7
See application file for complete search history.

(56) References Cited

U.S. PATENT DOCUMENTS 4,711,145 A * 12/1987 Inoue ..... 81/177.8
6,745,650 B1 * 6/2004 Chang ..... 81/177.8
6,886,429 B1 * 5/2005 Lee ..... 81/177.8
2005/0274234 A1 * 12/2005 Lee ..... 81/177.8

* cited by examiner

*Primary Examiner*—Hadi Shakeri
(74) *Attorney, Agent, or Firm*—Rosenberg, Klein & Lee

(57) ABSTRACT

A detent structure of a torque wrench for adjusting operation angle thereof, including a wrench handle, two detents, a resilient member and a working head. One end of the wrench handle is formed with a pivot cavity. Via the resilient member, the detents are movably disposed in the pivot cavity of the wrench handle. One end of each detent is formed with an engaging section having a connecting channel. The other end of each detent has a pres section. Two ends of the resilient member are formed with two connecting sections inserted in the connecting channels of the detents. One end of the working head has an engaging section pivotally disposed in the pivot cavity of the wrench handle. The engaging sections of the detents are engaged with the engaging section of the working head. By means of the resilient member disposed between the detents, a user can press the press sections of the detents with little strength to disengage the engaging sections of the detents from the engaging section of the working head. Under such circumstance, the working head can be easily pivoted to adjust operation angle.

5 Claims, 5 Drawing Sheets

DETENT STRUCTURE OF A TORQUE WRENCH FOR ADJUSTING OPERATION ANGLE THEREOF

BACKGROUND OF THE INVENTION

The present invention is related to a detent structure, and more particularly to a detent structure of a torque wrench for adjusting operation angle thereof.

A conventional torque wrench includes a ratchet, a detent and a resilient member disposed at one end of the wrench handle. The torque wrench can be switched between two wrenching directions. However, such torque wrench cannot be bent to adjust the angle of the working head. Therefore, such torque wrench cannot be used in some special conditions, for example, in a narrow space. Accordingly, the application range of the conventional torque wrench is limited.

SUMMARY OF THE INVENTION

It is therefore a primary object of the present invention to provide a detent structure of a torque wrench for adjusting operation angle thereof. The working head of the torque wrench is pivotally disposed on the wrench handle. By means of the detent structure, the operation angle of the working head is easily adjustable, whereby the application range of the torque wrench is widened.

It is a further object of the present invention to provide the above detent structure in which a resilient member is disposed between the detents of the detent structure. A user can press the press sections of the detents with little strength to deform the resilient member and disengage the engaging sections of the detents from the engaging section of the working head. Under such circumstance, the working head can be easily pivoted to adjust the operation angle of the working head.

The present invention can be best understood through the following description and accompanying drawings wherein:

DETAILED DESCRIPTION OF THE PREFERRED EMBODIMENTS

Figure 1:
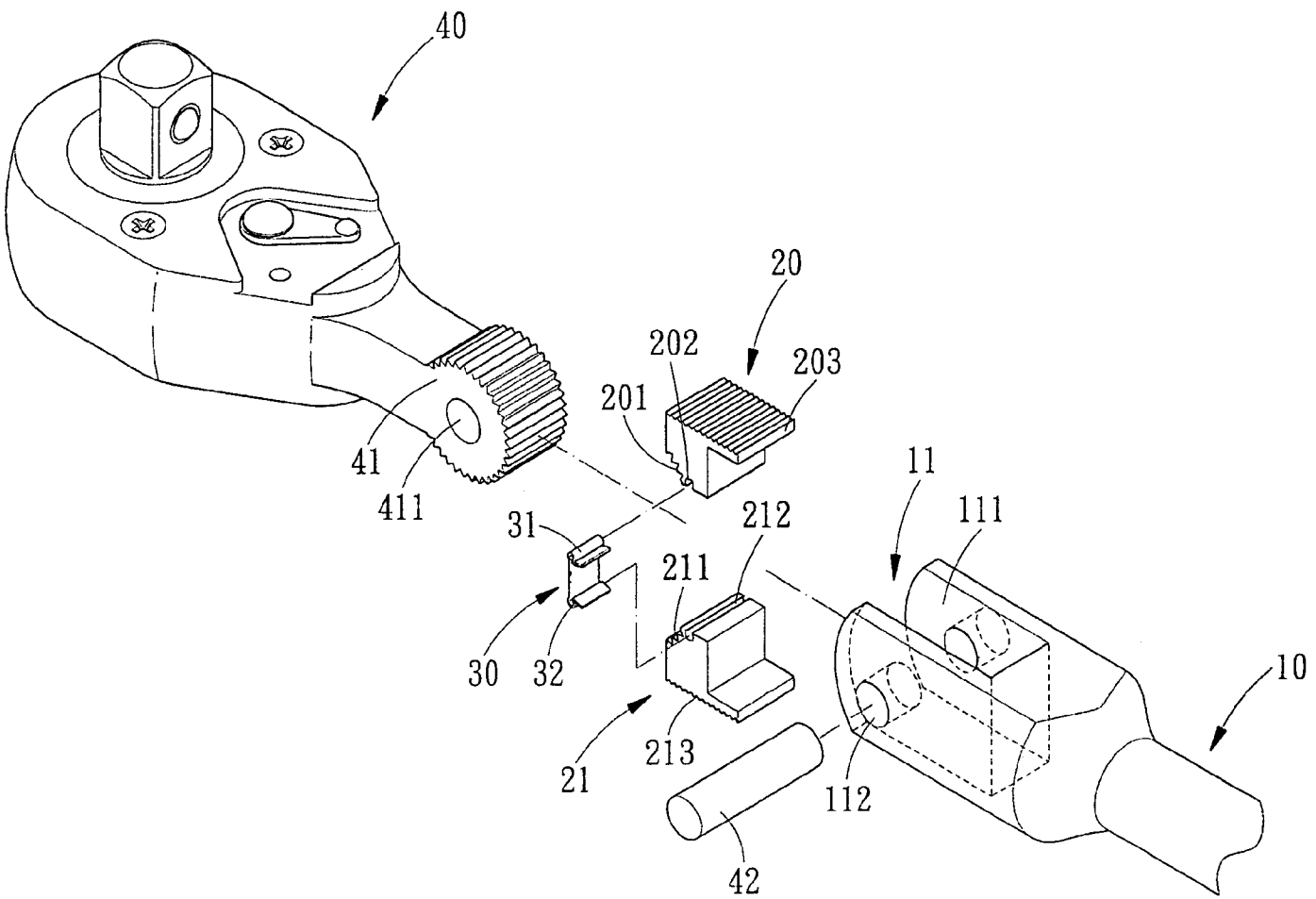
FIG. 1 is a perspective exploded view of the present invention.
Figure 2:
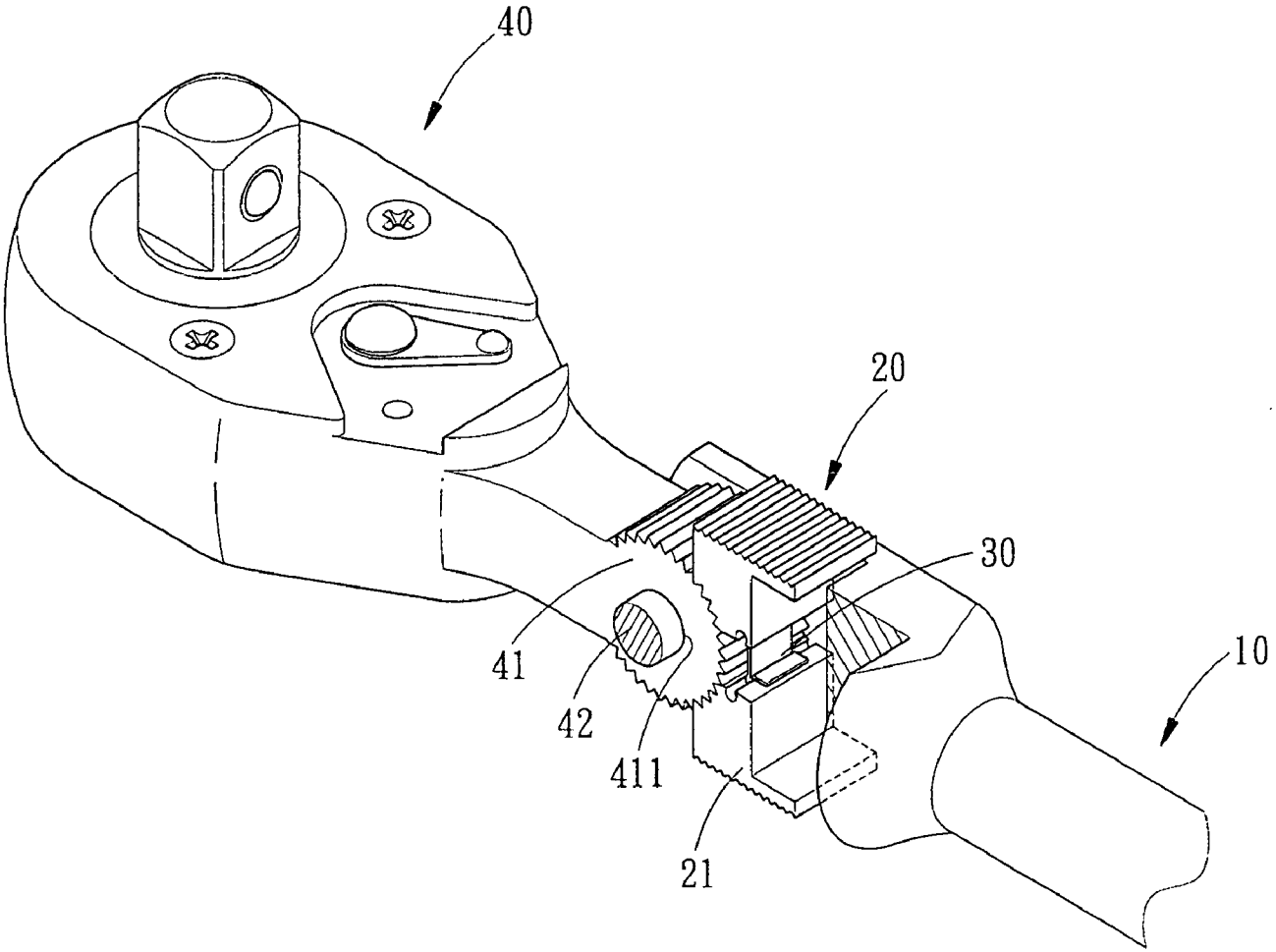
FIG. 2 is a perspective assembled view of the present invention.

Please refer to FIGS. 1 and 2. The present invention includes a wrench handle 10, two detents 20, 21, a resilient member 30 and a working head 40.

One end of the wrench handle 10 is formed with a pivot cavity 11 having two sidewalls 111. The sidewalls 111 are formed with pivot holes 112. The other end of the wrench handle 10 is for an operator to hold.

One side of each of the detents 20, 21 is formed with a wedged toothed engaging section 201, 211. The adjacent edges of the engaging sections 201, 211 are respectively formed with two connecting channels 202, 212 spaced from an end of the detent 20, 21. The surface of an opposing side of the detent 20, 21 is formed with a plurality of longitudinally spaced ridges. A portion of the ridged surface extending beyond the end of the detent 20, 21 defines a press section 203, 213.

The resilient member 30 is made of a flexible material. Two ends of the resilient member 30 are curled to form two ring-shaped connecting sections 31, 32. The connecting section 31 of one end of the resilient member 30 is inserted in the connecting channel 202 of the detent 20. The connecting section 32 of the other end of the resilient member 30 is inserted in the connecting channel 212 of the detent 21. Accordingly, via the resilient member 30, the detent 20 is connected with the other detent 21. The detents 20, 21 are movably disposed in the pivot cavity 11 of the wrench handle 10. The press sections 203, 213 of the detents 20, 21 are exposed to two outer sides of the bottom of the pivot cavity 11 of the wrench handle 10.

The wrenching direction of the working head 40 is changeable. One end of the working head 40 has a projecting engaging section 41 formed with a pivot through hole 411. The engaging section 41 has a toothed circumference. A pivot shaft 42 is fitted through the pivot hole 411 of the engaging section 41 and the pivot holes 112 of the wrench handle 10 so as to pivotally connect the working head 40 in the pivot cavity 11 of the wrench handle 10. The engaging sections 201, 211 of the detents 20, 21 are engaged with the engaging section 41 of the working head 40.

Figure 3:
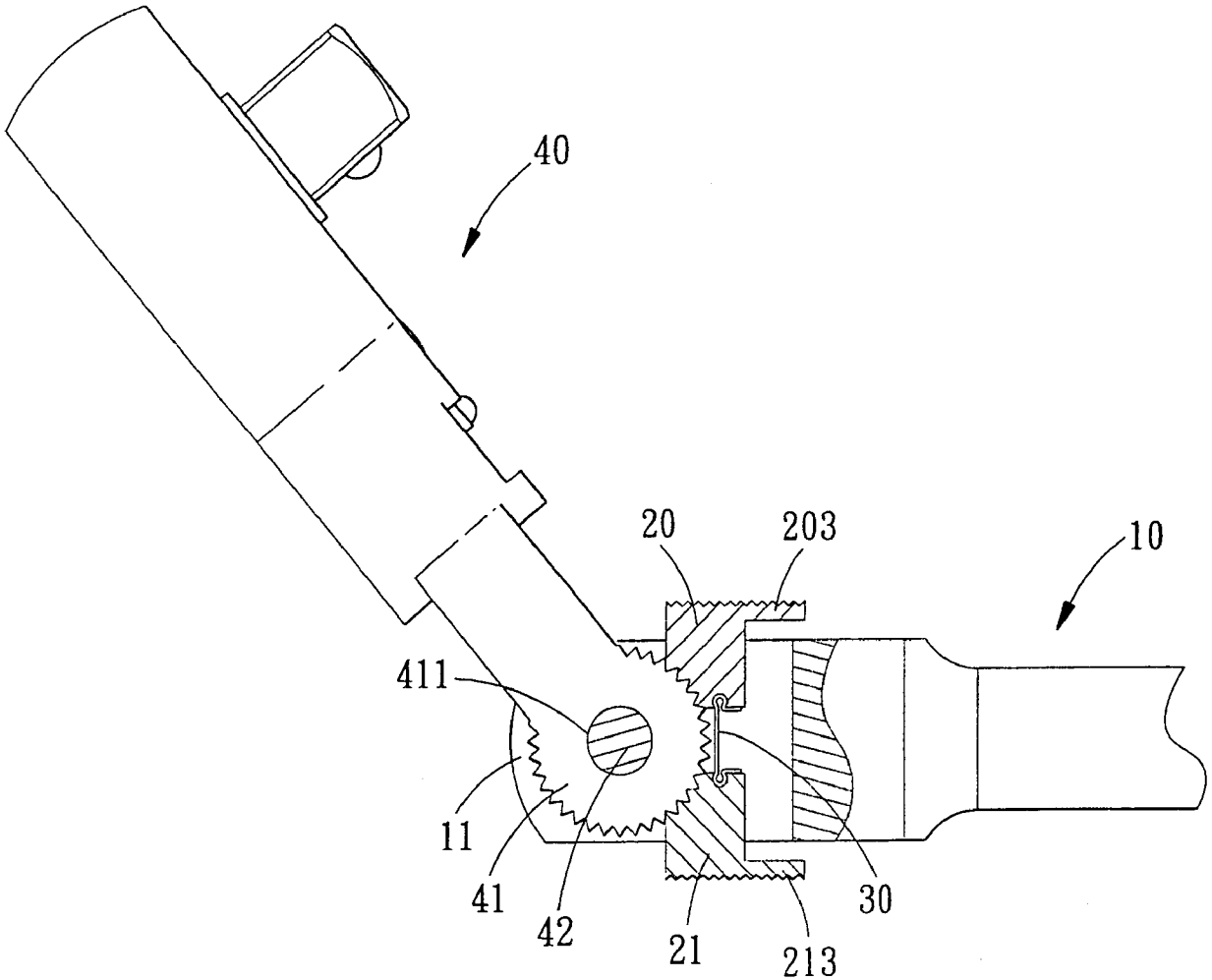
FIG. 3 is a sectional view of the present invention, in which the detents are not pressed.
Figure 4:
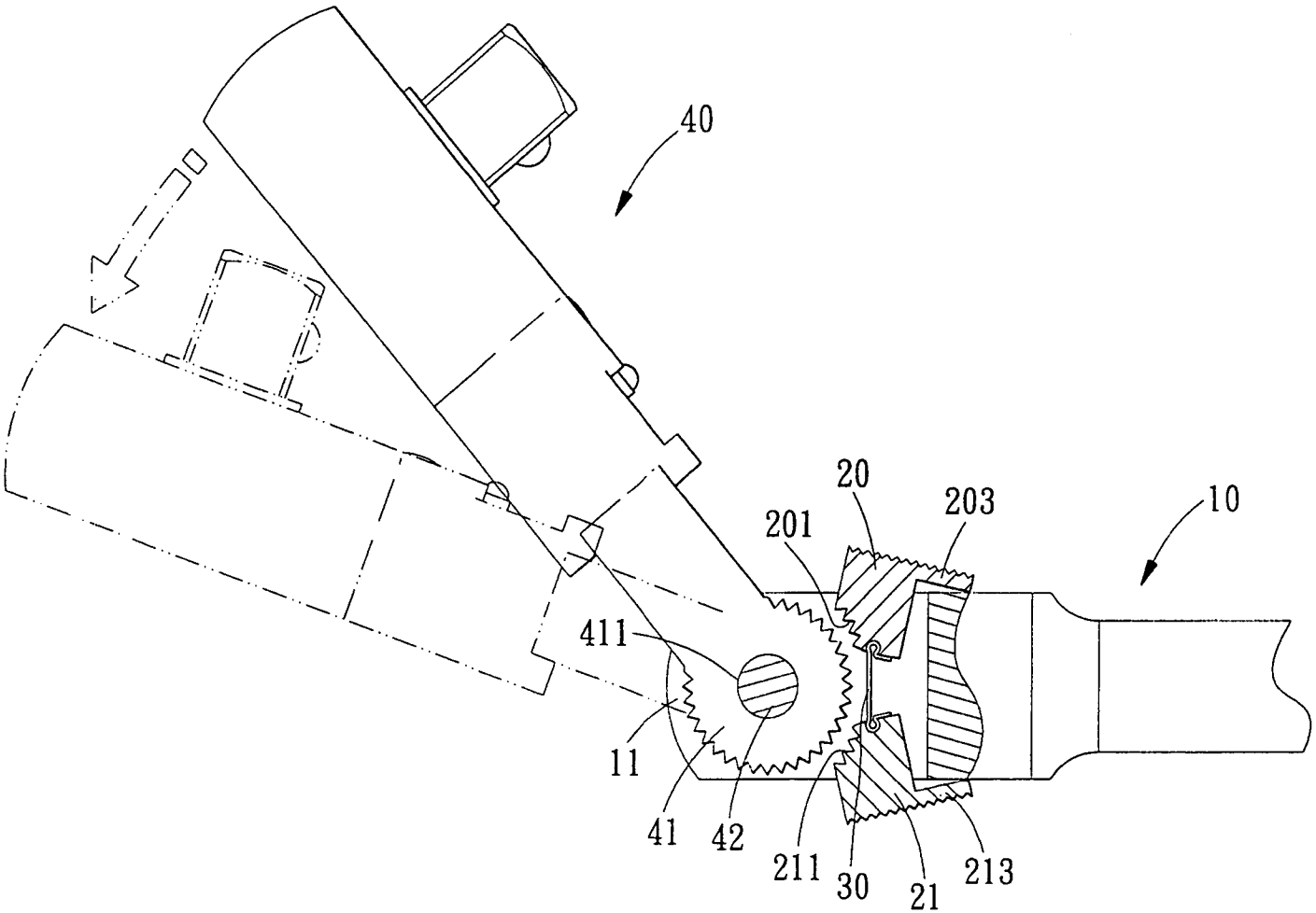
FIG. 4 is a sectional view of the present invention, in which the detents are pressed.

Please refer to FIGS. 3 and 4 which show the operation and function of the present invention. First, an operator presses the press sections 203, 213 of the detents 20, 21 to slightly deform the resilient member 30 mounted between the detents 20, 21. Under such circumstance, the engaging sections 201, 211 of the detents 20, 21 are disengaged from the engaging section 41 of the working head 40. At this time, the operator can adjust the working head 40 to a certain angle as necessary. After the adjustment is completed and the operator releases the press sections 203, 213 of the detents 20, 21, by means of the resilient force of the resilient member 30, the detents 20, 21 are restored to their home position. At this time, the engaging sections 201, 211 of the detents 20, 21 are again engaged with the engaging section 41 of the working head 40. Accordingly, the application range of the torque wrench can be widened.

By means of the resilient member 30 disposed between the detents 20, 21, a user can press the press sections 203, 213 of the detents 20, 21 with little strength to deform the resilient member and disengage the engaging sections 201, 211 of the detents 20, from the engaging section 41 of the working head 40. Under such circumstance, the working head 40 can be easily pivoted and adjusted.

Figure 5:
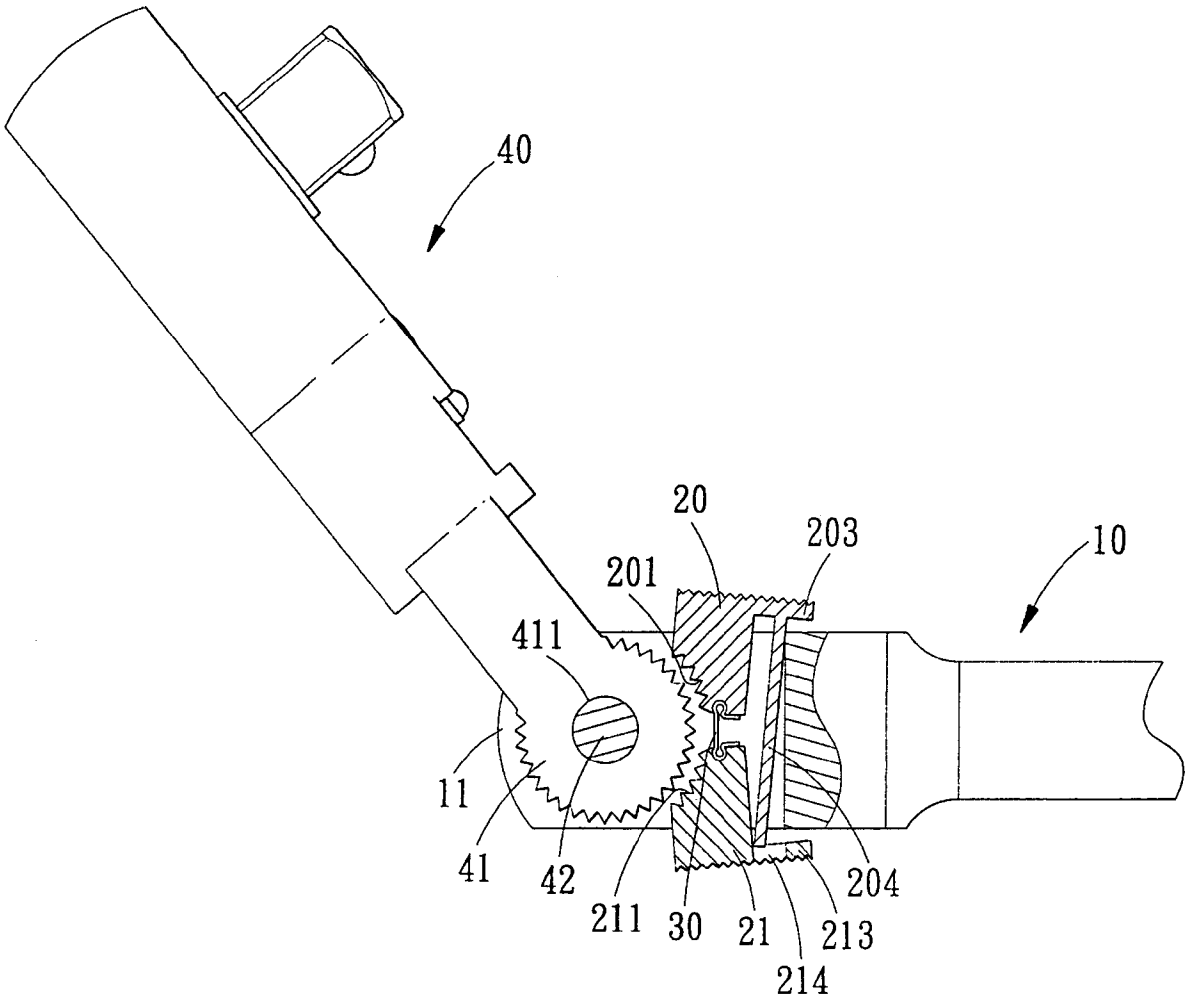
FIG. 5 is a sectional view of another embodiment of the present invention.

FIG. 5 shows another embodiment of the present invention, in which a pillar 204 projects from the press section 203 of the detent 20 and the press section 213 of the detent 21 is formed with a through hole 214. When an operator presses the press sections 203, 213 of the detents 20, 21, the pillar 204 of the detent 20 will extend through the through hole 214 of the detent 21 so as to achieve a locating effect in operation of the present invention.

The above embodiments are only used to illustrate the present invention, not intended to limit the scope thereof. Many modifications of the above embodiments can be made without departing from the spirit of the present invention.

What is claimed is:

1. A detent structure of a torque wrench for adjusting operation angle thereof, comprising:

a wrench handle, one end of the wrench handle being formed with a pivot cavity;

two detents, one end of each of the detents being formed with an engaging section, two adjacent edges of the engaging sections being respectively formed with two connecting channels, an opposing end of the detent being formed with a projecting press section, the detents being movably disposed in the pivot cavity of the wrench handle;

a resilient member, two ends of the resilient member being curled to form two ring-shaped connecting sections, the connecting sections of the resilient member being fixedly inserted in the connecting channels of the detents; and a working head, one end of the working head having an engaging section pivotally disposed in the pivot cavity of the wrench handle, the engaging sections of the detents being engaged with the engaging section of the working head.

2. The detent structure of the torque wrench as claimed in claim 1, wherein the pivot cavity of the wrench handle has two opposite sidewalls each formed with a pivot holes, the engaging section of the working head being formed with a pivot through hole, a pivot shaft being fitted through the pivot holes of the wrench handle and the working head, whereby the working head can be pivoted in the pivot cavity of the wrench handle.

3. The detent structure of the torque wrench as claimed in claim 1, wherein the engaging sections of the detents are toothed and the engaging section of the working head has a toothed circumference.

4. The detent structure of the torque wrench as claimed in claim 1, wherein a pillar projects from the press section of one of the detents and the press section of the other detent is formed with a through hole, whereby when the press sections of the detents are pressed, the pillar of the detent will extend through the through hole of the other detent.

5. The detent structure of the torque wrench as claimed in claim 1, wherein the projecting press section of each detent is formed with a plurality of longitudinally spaced ridges.

* * * * *